US009033745B2

(12) United States Patent
Kesiakov

(10) Patent No.: US 9,033,745 B2
(45) Date of Patent: May 19, 2015

(54) MINI SAS HD CONNECTOR

(71) Applicant: Dushko Kesiakov, Danville, CA (US)

(72) Inventor: Dushko Kesiakov, Danville, CA (US)

(73) Assignees: APPLIED MIRCO CIRCUITS CORPORATION, Sunnyvale, CA (US); VOLEX PLC, London (GB)

( * ) Notice: Subject to any disclaimer, the term of this patent is extended or adjusted under 35 U.S.C. 154(b) by 131 days.

(21) Appl. No.: 13/660,902

(22) Filed: Oct. 25, 2012

(65) Prior Publication Data

US 2014/0120787 A1 May 1, 2014

(51) Int. Cl.

| | |
|---|---|
| ***H01R 13/502*** | (2006.01) |
| ***H01R 13/50*** | (2006.01) |
| ***H01R 13/506*** | (2006.01) |
| ***H01R 13/40*** | (2006.01) |

(52) U.S. Cl.

CPC ..... *H01R 13/501* (2013.01); *H01R 13/506* (2013.01); *H01R 13/40* (2013.01)

(58) Field of Classification Search

USPC ..... 439/687, 731, 594, 465.686, 696, 695, 439/732, 716, 717; 174/561, 656, 559; 200/293, 303

See application file for complete search history.

(56) References Cited

U.S. PATENT DOCUMENTS

| | | | | |
|---|---|---|---|---|
| 6,705,894 | B1 * | 3/2004 | Comerci et al. | 439/607.47 |
| 7,163,424 | B2 * | 1/2007 | Dancel et al. | 439/731 |
| 2004/0097122 | A1 * | 5/2004 | Garrett et al. | 439/378 |
| 2011/0194823 | A1 * | 8/2011 | Wu | 385/92 |

* cited by examiner

*Primary Examiner* — Abdullah Riyami
*Assistant Examiner* — Harshad Patel
(74) *Attorney, Agent, or Firm* — Baker & Hostetler LLP

(57) ABSTRACT

An apparatus including top and bottom portions that when mated form a connector. The top portion includes a top connector portion including a first wall, a second wall opposite the first wall, a first top cap connecting the first and second walls, and wherein the first wall comprises a first concave/convex feature for interlocking. The bottom portion includes a bottom connector portion configured to mate with the top connector portion to form the connector. The bottom connector portion includes a third wall, a fourth wall opposite the third wall, a first bottom connecting the third wall and the fourth wall, and wherein the third wall includes a second concave/convex feature for interlocking with the first concave/convex feature, wherein the second concave/convex feature is oriented opposite the first concave/convex feature.

17 Claims, 4 Drawing Sheets

MINI SAS HD CONNECTOR

BACKGROUND

The term "SAS" is known in the art to refer to "Serial Attached SCSI." The term "SCSI" is known in the art to refer to "Small Computer System Interface." Current miniature SAS ("mini SAS") connectors require strict adherence to SAS specifications. At the connecting end, a rectangular interface that is hollow connects to a receiving port. The rectangular interface has very thin walls that are difficult to machine.

As such, prior techniques for manufacturing mini SAS connectors were restricted to die casting processes. Specifically, the connector was formed as a single piece by forcing molten metal under high pressure into a mould. In that manner, a connector with very thin walls could be manufactured.

A significant drawback to a single-piece connector, such as those formed through die casting, is the difficulty in threading components (e.g., wiring) through the connector and through an attached housing component. For instance, the housing component may be comprised of a split structure with top and bottom halves. One of the halves also would be attached to the single-piece connector. By fitting the top and bottom halves an enclosure would be formed for protecting components. However, before the top and bottom halves could be fitted, the components would have to be threaded first through the single-piece connector, and then positioned to be enclosed within the housing component. Threading components through the single-piece connector is difficult and time consuming.

What is required is a connector that allows for easy placement or threading of components.

SUMMARY

An apparatus including top and bottom portions. The top portion and the bottom portion are mated to form a connector having an inner cavity. The top portion includes a top connector portion. The top connector portion includes a first wall and a second wall that is configured opposite the first wall. The top connector portion includes a first top cap that is configured to connect the first and second walls. In addition, the first wall comprises a first concave/convex feature for interlocking. Further, the bottom portion includes a bottom connector portion. The bottom connector portion is configured to mate with the top connector portion to form the connector. The bottom connector portion includes a third wall and a fourth wall that is configured opposite the third wall. The bottom connector portion includes a first bottom that is configured to connect the third wall and the fourth wall. In addition, the third wall includes a second concave/convex feature for interlocking with the first concave/convex feature of the top portion. The second concave/convex feature is oriented opposite the first concave/convex feature.

BRIEF DESCRIPTION OF THE DRAWINGS

The accompanying drawings, which are incorporated in and form a part of this specification and in which like numerals depict like elements, illustrate embodiments of the present disclosure and, together with the description, serve to explain the principles of the disclosure.

DETAILED DESCRIPTION

Reference will now be made in detail to the various embodiments of the present disclosure, examples of which are illustrated in the accompanying drawings. While described in conjunction with these embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Accordingly, embodiments of the present disclosure provide for a mini SAS HD housing that includes a split connector portion having a pair of interlocking S-shaped concave and convex features that interlock together. The mini SAS HD housing, including the split connector portion, is manufactured through die casting and/or conventional machining processes. The mini SAS HD housing, including the split connector portion, is configured into top and bottom halves that allows for convenient threading of components, especially through the connector portion. Further, the mini SAS HD housing in embodiments of the invention provide for self alignment and interlocking, thereby allowing securing of two halves with a single point of contact retaining element (e.g., retaining clip, screw, or similar hardware, etc.). Embodiments of the present invention provide for simplified assembly of the mini SAS HD housing.

In embodiments, the mini SAS HD housing includes two nearly symmetrical halves which snap together. In order for the mini SAS HD housing to be kept in a locked position with respect to the symmetrical halves, the housing includes retainers at various locations along the assembly length.

Figure 1:
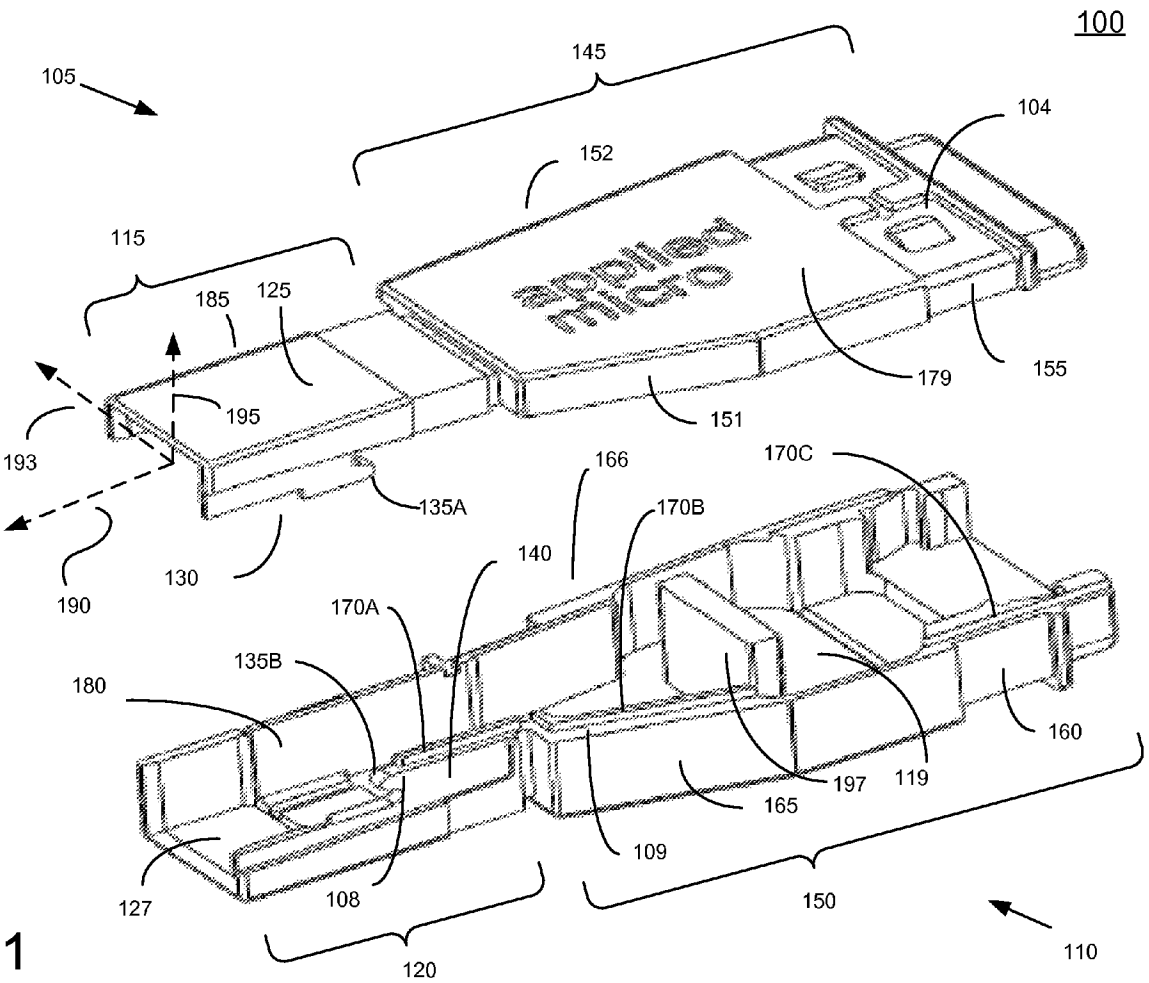
FIG. 1 is a perspective view of two separated portions of a mini SAS high density (HD) housing including a connector portion, in accordance with one embodiment of the present disclosure.

FIG. 1 is a perspective view of two separated portions of a mini SAS high density (HD) housing 100 including a connector portion, in accordance with one embodiment of the present disclosure. As shown in FIG. 1, the mini SAS HD housing 100 includes a top portion 105 and a bottom portion 110. The top portion 105 and the bottom portion are mated to form a connector 255 having an inner cavity.

More specifically, the top portion 105 includes a top connector portion 115. The top connector portion 115 includes a first wall 130, and a second wall 185. In one embodiment, the second wall is configured opposite the first wall, and a first top cap 125 is configured to connect the first wall 130 to the second wall 185. As shown, the first top cap 125 is configured substantially in rectangular fashion, and the first wall 130 and the second wall 130 extend in parallel from top cap 125.

In addition, the first wall 130 includes a first concave/convex feature 135A for purposes of interlocking. Feature 135A is configured in an S-shaped concave and/or convex fashion. As shown in FIG. 1, the first concave/convex feature 135A is oriented such that the S-shape is in a forward "S" orientation.

In addition, the bottom portion 110 includes a bottom connector portion 120. The bottom connector portion 110 is configured to mate with the top connector portion 105 to form a connector 255. In particular, the bottom connector portion 110 includes a third wall 140, and a fourth wall 180. In one embodiment, the fourth wall 180 is configured opposite the third wall 140, and a first bottom 127 is configured to connect the third wall 140 to the fourth wall 180. As shown, the bottom 127 is configured substantially in rectangular fashion, and the third wall 140 and the fourth wall 180 extend in parallel from bottom 127.

In one embodiment, the third wall 140 includes a second concave/convex feature 135B that is configured to interlock with the first concave/convex feature 135A. more specifically, feature 135B is configured in an S-shaped concave and/or convex fashion. As shown in FIG. 1, feature 135B is oriented such that the S-shape of the second concave/convex feature is oriented opposite to the first concave/convex feature 135B. That is, feature 135B is oriented such that the S-shape is in a reverse "S" orientation.

Furthermore, as shown in FIG. 1, the first wall 130 and the second wall 185 are oriented in parallel fashion. Also, the third wall 140 and the fourth wall 180 are oriented in parallel fashion. When the top connector portion 115 is mated with the bottom connector portion 120, the first wall 130 mates with the third wall 140, such that the walls are aligned. Also, when the top connector portion 115 is mated with the bottom connector portion 120, the second wall 185 mates with the fourth wall 180, such that the walls are aligned.

More particularly, to form the connector 255, the top connector portion 115 is mated with the bottom connector portion 120 by interlocking features 135A and 135B. That is, the first concave/convex feature 135A of the top connector portion 115 is interlocked with the second concave/convex feature 135B of the bottom connector portion 120. When interlocked, the pair of S-shaped concave and/or concave features 135A-B in both mating parts eliminate three degrees of freedom. Specifically, translation upwards and downwards with respect to a horizontal axis 190 is eliminated. In addition, rotations about both horizontal axis 190 and lateral axis 193 are eliminated.

Further, third wall 140 includes at least one guiding rail that is attached to a top surface and/or edge 108 of the third wall 140. The at least one guiding rail is indented and configured to guide the first wall 130 of the top connector portion 115 into position when mating with the third wall 140 of the bottom connector portion 120. For instance, for illustration third wall 140 includes guide rail 170A.

Guide rails 170A-C of FIG. 1 limits a certain number of degrees of freedom between the top portion 105 and the second portion 110. For instance, as shown in FIG. 1, guide rails 170A-C limit two degrees of freedom, including eliminating a translation from side to side along lateral axis 193, and eliminating a rotation about vertical axis 195.

In addition, when the top connector portion 115 is mated with the bottom connector portion 120, an inner cavity is formed. As shown in FIG. 1, inner cavity is characterized with a first end 220. In one embodiment, the first end 220 and connector 255 are configured in compliance with an SAS standard, and its derivatives. In that manner, connector 255 is able to interface with other standard ports for purposes of facilitating communicating using the SAS standard.

Further, the top portion 105 also includes a top housing portion 145, wherein portion 145 is attached to the top connector portion 115. In that manner, the top housing portion 145 extends the assembly length of the mini SAS HD housing 100 along the horizontal axis 190. The top housing portion 145 includes a first flange 151 that is attached to and extends from the first wall 130 of the top connector portion 115. The top housing portion also includes a second flange 152 that is attached to and extends from the second wall 185 of the top connector portion 115. In one embodiment, the first flange 151 is configured opposite the second flange 152. In addition, a second top cap 179 connects the first flange 151 and the second flange 152. In addition, the second top cap 179 is attached to and extends from the first top cap 125 of the top connector portion 115.

In addition, the bottom portion 110 also includes a bottom housing portion 150, wherein portion 150 is attached to the bottom connector portion 120. In that manner, the bottom housing portion 150 extends the assembly length of the mini SAS HD housing 100 along the horizontal axis 190. The bottom housing portion 150 is configured to mate with the top housing portion 145 to form a housing 257. In that manner, the inner cavity extends through the connector 255 and the housing 257, such that the inner cavity has a first end 220 and a second end 225.

More specifically, the housing bottom portion 150 includes a third flange 165 that is attached to and extends from the third wall 140 of the connector bottom portion 120. In addition, the housing bottom portion 150 includes a fourth flange 166 that is attached to and extends from the fourth wall 180 of the connector bottom portion 120. In one embodiment, the third flange 165 is configured opposite the fourth flange 166. In addition, a second bottom 119 connects the third flange 165 and the fourth flange 166. Also, the second bottom 119 is attached to and extends from the first bottom 127 of the bottom connector portion 120.

As shown in FIG. 1, the third flange 165 includes at least one guiding rail that is attached to a top surface and/or edge 109 of the third flange 165. The at least one guiding rail is indented and configured to guide the first flange 151 of the top housing portion 145 into position when mating with the third flange 165 of the bottom housing portion 150. For instance, for illustration third flange 165 includes guide rails 170B and 170C.

Moreover, the top housing portion 145 includes a top channel 155 for accepting a retaining element (not shown). In addition, the bottom housing portion 150 includes a bottom channel 160 for accepting the retaining element. The bottom channel 160 is configured to mate with the top channel to form a channel 260 for accepting the retaining element.

As shown in FIG. 1, the top housing portion 145 includes at least one locking element 104 that is configured to lock the retaining element (not shown), previously introduced. As such, the locking element 104 locks the retaining element in the channel 260.

In one embodiment, the retaining element (not shown) comprises any locking element, such as, a standard "off the shelf" piece of hardware, or one that is custom designed. The retaining element secures the top portion 105 and the bottom portion n110 together. As such, the retaining element when positioned in the channel 260 eliminates a translation along the guiding rails 170A-C. Specifically, the retaining element creates friction along the guiding rails 170A-C. For example, the retaining element comprises a shear loaded screw, pin, elastic band, metal clip, etc.

Further, the bottom housing portion 150 includes an optional support structure 197. In that manner, the support structure 197 provides support to the top housing portion 145 and or second top cap 179, when the top portion 105 is mated with the bottom portion 110.

Figure 2A:
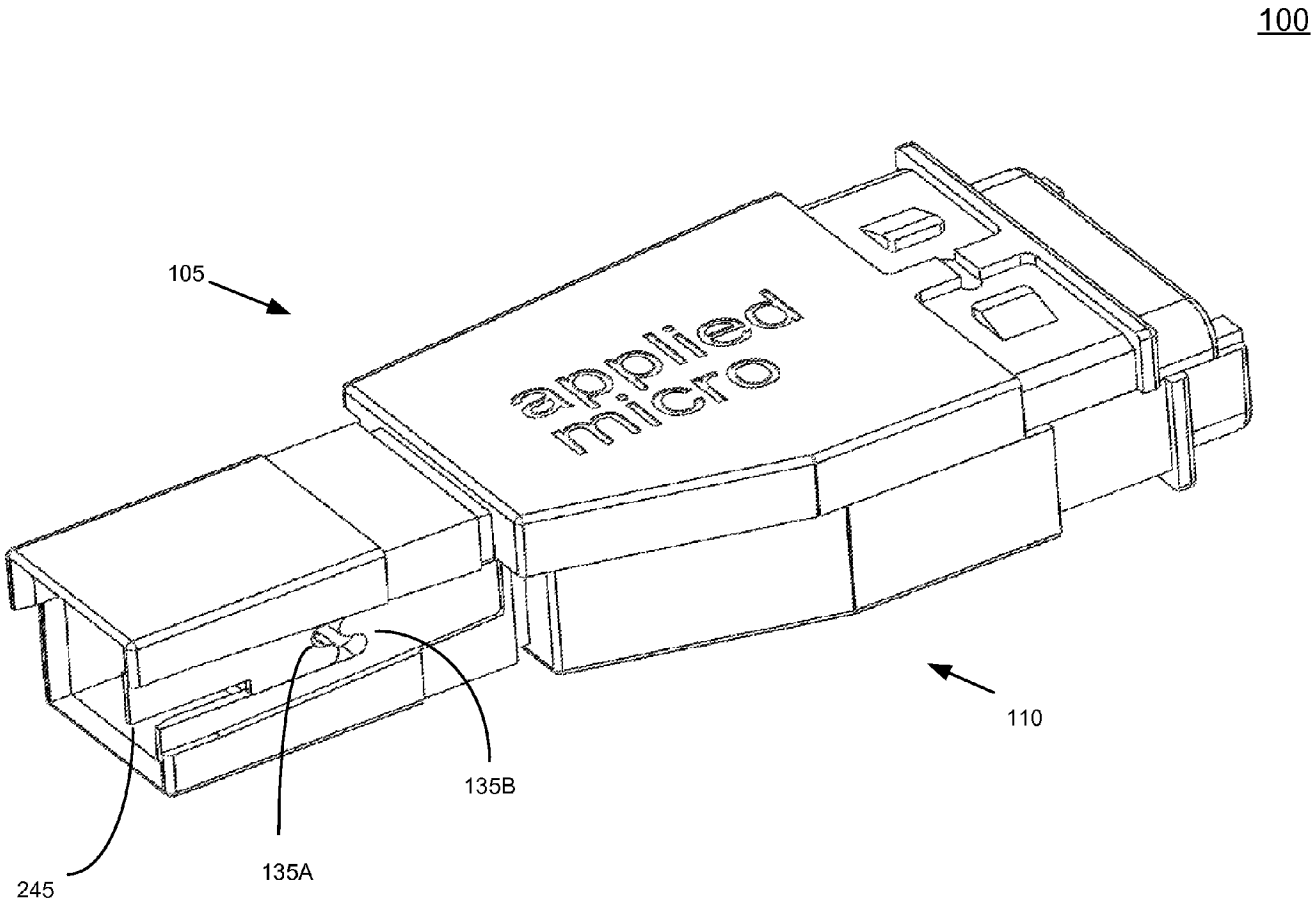
FIG. 2A is a perspective view of two portions of a mini SAS HD housing including a connector portion positioned for mating and including a pair of mating parts (e.g., interlocking S-shaped concave and convex features) that interlock together, in accordance with one embodiment of the present disclosure.

FIG. 2A is a perspective view of two portions of a mini SAS HD housing 100 including a connector portion positioned for mating and including a pair of mating parts (e.g., interlocking S-shaped concave and convex features) that interlock together, in accordance with one embodiment of the present disclosure. In particular, top portion 105 is aligned with bottom portion 110 in a manner that S-shaped concave/convex features 135A and 135B are in a position to be interlocked. That is, the S-shaped concave/convex features 135A and 135B have not yet been engaged.

In one embodiment, S-shaped concave/convex features 135A and 135B are configured to provide an offset 245 (e.g., 1.5 mm). The offset 245 allows S-shaped concave/convex features 135A and 135B to engage properly.

Figure 2B:
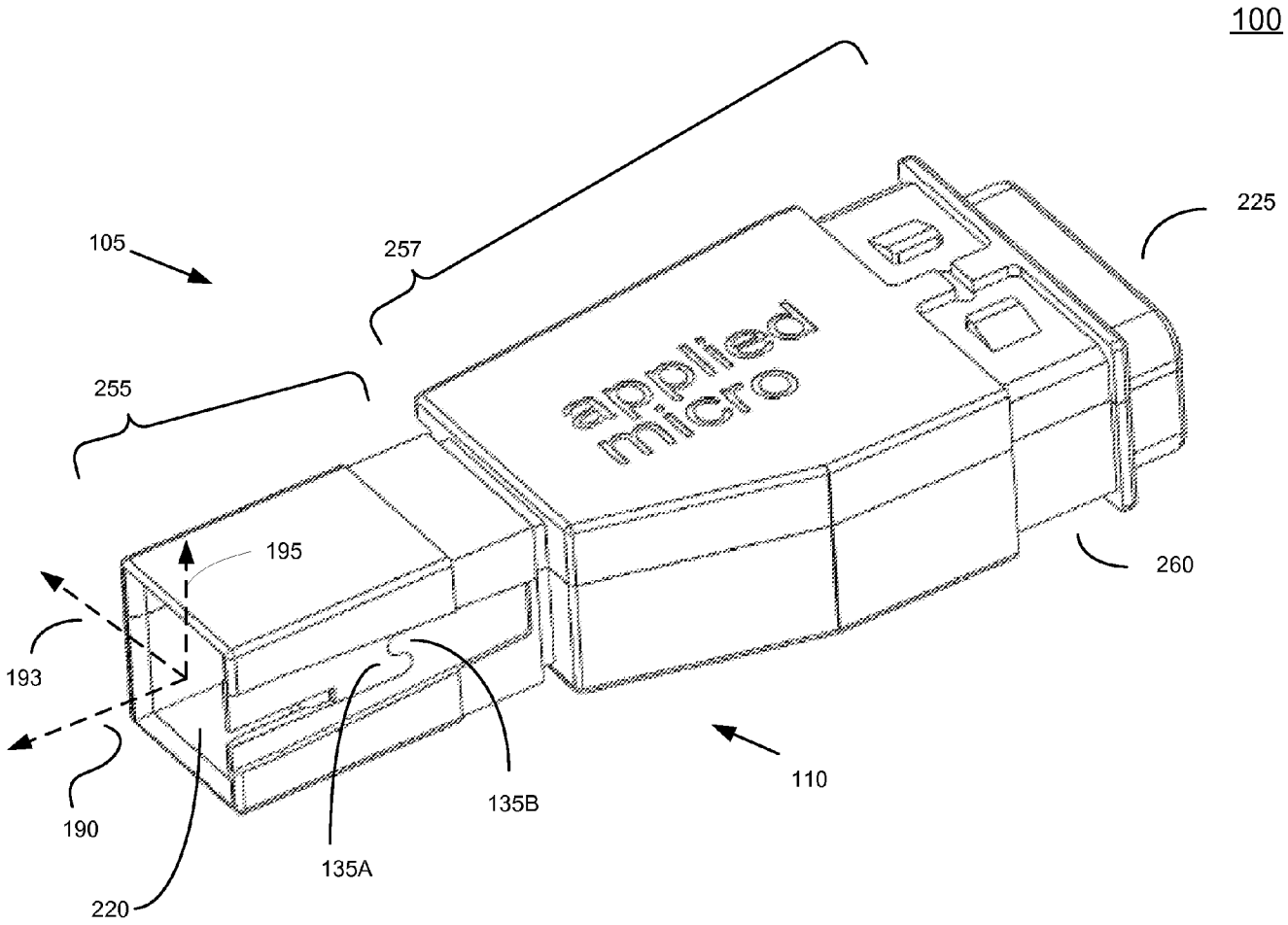
FIG. 2B is a perspective view of two portions of the mini SAS HD housing including a connector portion of FIG. 2A that is in a mated position, such that a pair of mating parts (e.g., interlocking S-shaped concave and convex features) are interlocked, in accordance with one embodiment of the present disclosure.

FIG. 2B is a perspective view of two portions of the mini SAS HD housing 100 including a connector portion of FIG. 2A that is in a mated position, such that a pair of mating parts (e.g., interlocking S-shaped concave and convex features) are interlocked, in accordance with one embodiment of the present disclosure. In particular top portion 105 is fully aligned and engaged with bottom portion 110 in a manner that S-shaped concave/convex features 135A and 135B are interlocked. That is, S-shaped concave/convex features 135A and 135B are fully engaged.

Figure 3A:
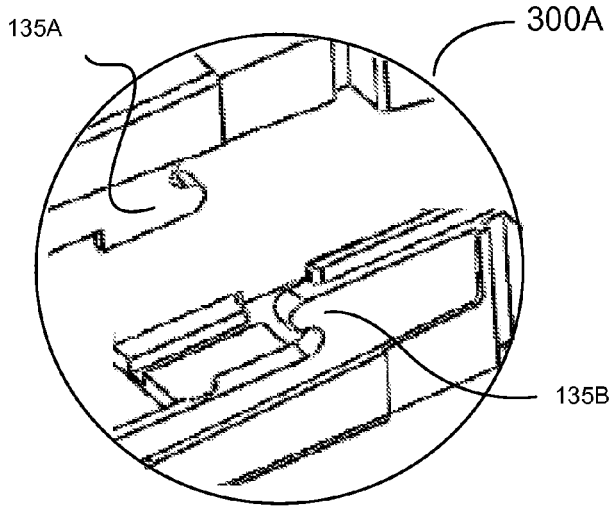
FIGS. 3A-C are blown-up perspective views of a pair of mating parts in various alignment positions, in accordance with embodiments of the present disclosure.
Figure 3B:
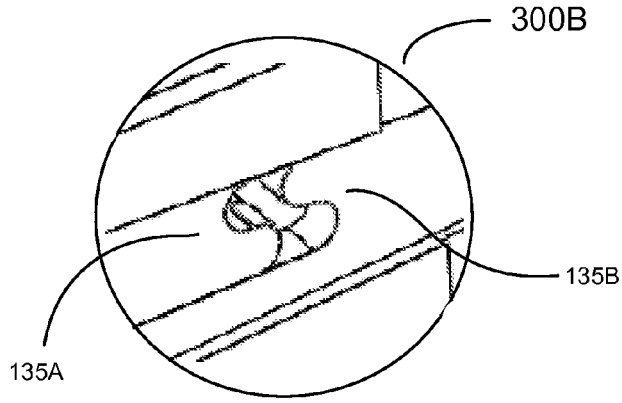
Figure 3C:
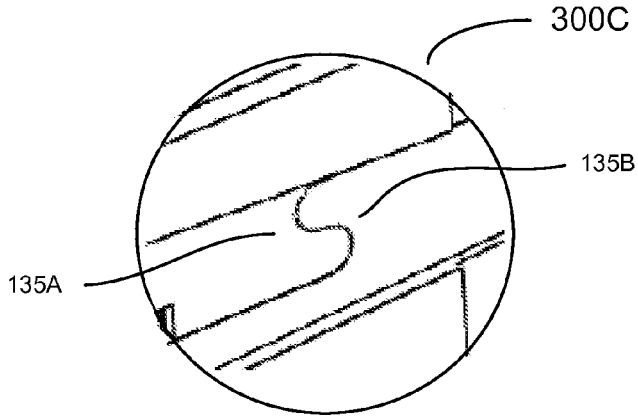

FIGS. 3A-C are blown-up perspective views of a the pair of interlocking S-shaped concave/convex features 135A and 135B of the mini SAS HD housing 100 of FIGS. 1 and 2A-B in various positions of alignment, in accordance with embodiments of the present disclosure. In particular, FIG. 3A shows a blow-up view 300A illustrating the S-shaped concave/convex features 135A and 135B separated from each other. FIG. 3B shows a blow-up view 300B illustrating the S-shaped concave/convex features 135A and 135B moving into alignment just prior to mating in a fully engaged position. FIG. 3C shows a blow-up view 300C illustrating the S-shaped concave/convex features 135A and 135B fully engaged.

Thus, according to embodiments of the present disclosure, a mini SAS HD housing is described and includes a split connector portion having a pair of interlocking S-shaped concave and convex features that interlock together.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as may be suited to the particular use contemplated.

Embodiments according to the present disclosure are thus described. While the present disclosure has been described in particular embodiments, it should be appreciated that the disclosure should not be construed as limited by such embodiments.

The invention claimed is:

1. An apparatus, comprising:

a top portion;

a bottom portion, wherein said top portion and bottom portion are mated together to form a connector having an inner cavity and configured for insertion into a receiving port;

wherein said top portion comprises a top connector insertion portion, said top connector insertion portion-comprising:

a substantially planar first wall;

a second wall opposite said first wall;

a first top cap connecting said first and second walls; and wherein said first wall comprises a first concave/convex feature within the plane of the first wall for interlocking; and wherein said bottom portion comprises a bottom connector insertion portion configured to mate with said top connector insertion portion to form said connector, said bottom connector insertion portion comprising:

a substantially planar third wall; wherein the first wall and the third wall are coplanar a fourth wall opposite said third wall; and a first bottom connecting said third wall and said fourth wall; and wherein said third wall comprises a second concave/convex feature within the plane of third wall for interlocking with said first concave/convex feature, wherein said second concave/convex feature is oriented opposite said first concave/convex feature.

2. The apparatus of claim 1, wherein said first and second walls of said top portion are oriented in parallel, and said third and fourth wall of said bottom portion are oriented in parallel.

3. The apparatus of claim 1, wherein said first wall is mated with said third wall when said first and second concave/convex features are interlocked.

4. The apparatus of claim 3, wherein said second wall is mated with said fourth wall when said first and second concave/convex features are interlocked, such that said top connector insertion portion and bottom connector insertion portion when mated form said inner cavity that is open at one end.

5. The apparatus of claim 4, wherein said connector is a SAS connector.

6. The apparatus of claim 1, further comprising;

wherein said top portion comprises a top housing portion attached to said top connector insertion portion, said top housing portion comprising;

a first flange attached to and extending from said first wall;

a second flange attached to and extending from said second wall; and a second top cap connecting said first flange and said second flange;

wherein said second top cap is attached to and extends from said first top cap of said connector; and wherein said bottom portion comprises a bottom housing portion configured to mate with said top housing portion to form a housing, said bottom housing portion comprising:

a third flange attached to and extending from said third wall;

a fourth flange attached to and extending from said fourth wall; and a second bottom connecting said third flange and said fourth flange, and wherein said second bottom is attached to and extends from said first bottom of said connector.

7. The apparatus of claim 6, wherein said third flange of said bottom housing portion further comprises:

at least one guiding rail attached to a top surface of said third flange and indented and configured to guide said first flange of said top housing portion into position when mating by sliding motion along a horizontal axis with said third flange of said bottom housing portion.

8. The apparatus of claim 7, wherein said at least one guiding rail prevents side-to-side translation along a lateral axis and prevents rotation about a vertical axis.

9. The apparatus for claim 6, further comprising:

wherein said top housing portion comprises a top channel for accepting a retaining element; and wherein said bottom housing portion comprises a bottom channel for accepting said retaining element, wherein said bottom channel is configured to mate with said top channel to form a channel for accepting said retaining element.

10. The apparatus of claim 9, wherein said top housing portion comprises:

at least one locking element configured to lock said retaining element within said channel.

11. The apparatus of claim 6, wherein said housing is configured to form an extension to said inner cavity that is open at one end.

12. The apparatus of claim 6, wherein said housing and said connector are configured to form an extension to said inner cavity that is open at a first end and open at a second end.

13. The apparatus of claim 6, further comprising:

a support structure attached to said bottom to provide support for said second top cap.

14. The apparatus of claim 1, wherein said first concave/convex feature comprises a concave feature, and wherein said second concave/convex feature comprises a convex feature.

15. The apparatus of claim 1, wherein said first concave/convex feature and said second concave/convex feature when interlocked prevents translation about a horizontal axis and prevents rotation about said horizontal axis and a lateral axis.

16. The apparatus of claim 1, wherein said third wall of said bottom connector insertion portion further comprises:

at least one guiding rail attached to a top surface of said third wall and indented and configured to guide said first wall of said top connector insertion portion into position when mating with said third wall of said bottom connector insertion portion.

17. The apparatus of claim 15, wherein said at least one guiding rail prevents side-to-side translation along a lateral axis and prevents rotation about a vertical axis.

* * * * *